US006637134B2

(12) United States Patent
Hammerle

(10) Patent No.: US 6,637,134 B2
(45) Date of Patent: Oct. 28, 2003

(54) SNOW TRACK PREPARATION MACHINE WITH MILL MOUNTED IN A REVOLVING MANNER

(75) Inventor: Ulrich Hammerle, Lech/At (AT)

(73) Assignee: Prinoth GmbH SRL (IT)

( * ) Notice: Subject to any disclaimer, the term of this patent is extended or adjusted under 35 U.S.C. 154(b) by 0 days.

(21) Appl. No.: 10/084,695

(22) Filed: Feb. 27, 2002

(65) Prior Publication Data

US 2002/0139013 A1 Oct. 3, 2002

(30) Foreign Application Priority Data

Mar. 30, 2001 (IT) ..... BZ2001A0017

(51) Int. Cl.[7] ..... G01H 5/04; G02F 3/64; G05D 1/08

(52) U.S. Cl. ..... 37/234; 37/245; 37/247; 37/415; 701/50

(58) Field of Search ..... 37/219, 223, 232, 37/234, 348, 244, 245, 247, 382, 413, 414, 415, 196; 701/50

(56) References Cited

U.S. PATENT DOCUMENTS 3,741,311 A * 6/1973 Fleurant ..... 172/45
3,779,319 A * 12/1973 Pease ..... 172/45
4,560,303 A * 12/1985 Haug et al. ..... 404/118
5,809,671 A * 9/1998 Sinykin ..... 37/219
6,295,746 B1 * 10/2001 Meduna et al. ..... 37/382
6,354,023 B1 * 3/2002 Trahan et al. ..... 37/219

FOREIGN PATENT DOCUMENTS

EP 242437 * 10/1987

* cited by examiner

*Primary Examiner*—Robert E. Pezzuto
*Assistant Examiner*—Thomas A. Beach
(74) *Attorney, Agent, or Firm*—Shiesinger, Fitzsimmons & Shlesinger

(57) ABSTRACT

Snow track preparation machine with mill installed in a revolving manner and including a pump driven by a power source, a hydraulic motor connected to the pump on the delivery side and the return side, an actuator supported on the assembly frame and realized for rotation of the mill and driving wheels. The power source is made up of a motor (2) which drives the driving wheels (5,6) and the pump (9) and actuator (16) are influenced by a control unit (17) connected to a sensor of motor rpm $n_D$, to a sensor of the rpm of the driving wheels $n_{a1}$ and $n_{a2}$, to a sensor for the hydraulic motor of the mill and an actuator path sensor with the control unit (17) connecting the magnitudes detected by the sensors by means of an algorithm and controlling on the basis thereof the pump (9) and the actuator.

7 Claims, 6 Drawing Sheets

RPM CONTROL WITH FLOW REGULATOR

SNOW TRACK PREPARATION MACHINE WITH MILL MOUNTED IN A REVOLVING MANNER

DESCRIPTION

The present invention relates to a snow track preparation machine with mill mounted in a revolving manner in accordance with the classifying part of claim 1.

A tracked vehicle for the preparation of snow tracks in which for operation of a snow mill at least one electric drive is provided for the snow mill shaft synchronized with an electric motor of the drive wheel or the sprocket of the tracked vehicle is known from document EP 0 895 495 B1. This should ensure uniformly good track preparation because in this manner mill shaft rpm and running speed are adapted to each other and the result is a definite number of engagements of the mill shaft teeth per path unit. This way running powers comparable in particular to or better than those of a hydrostatic drive should be obtained.

The general purpose of the present invention is found in the fact of obtaining both a definite number of mill teeth engagements per unit of path and also having available a mill teeth cutting depth such that it should be possible to obtain low injection of energy into the snow.

These and other purposes are achieved by a snow track preparation machine with a mill mounted in a revolving manner in accordance with the characteristics of the characterizing part of claim 1.

Due to the fact that mill teeth cutting depth which depends on cutting angle $\alpha$ and mill shaft rpm $n_F$ are controlled in such a manner that the work injected in the snow per unit of path (J/m), uniform track quality is maintained regardless of change in running speed or teeth engagement geometry.

Additional characteristics and details are set forth in the following description of a preferred embodiment of the snow track preparation machine in accordance with the present invention. In the FIGS—

Figure 1:
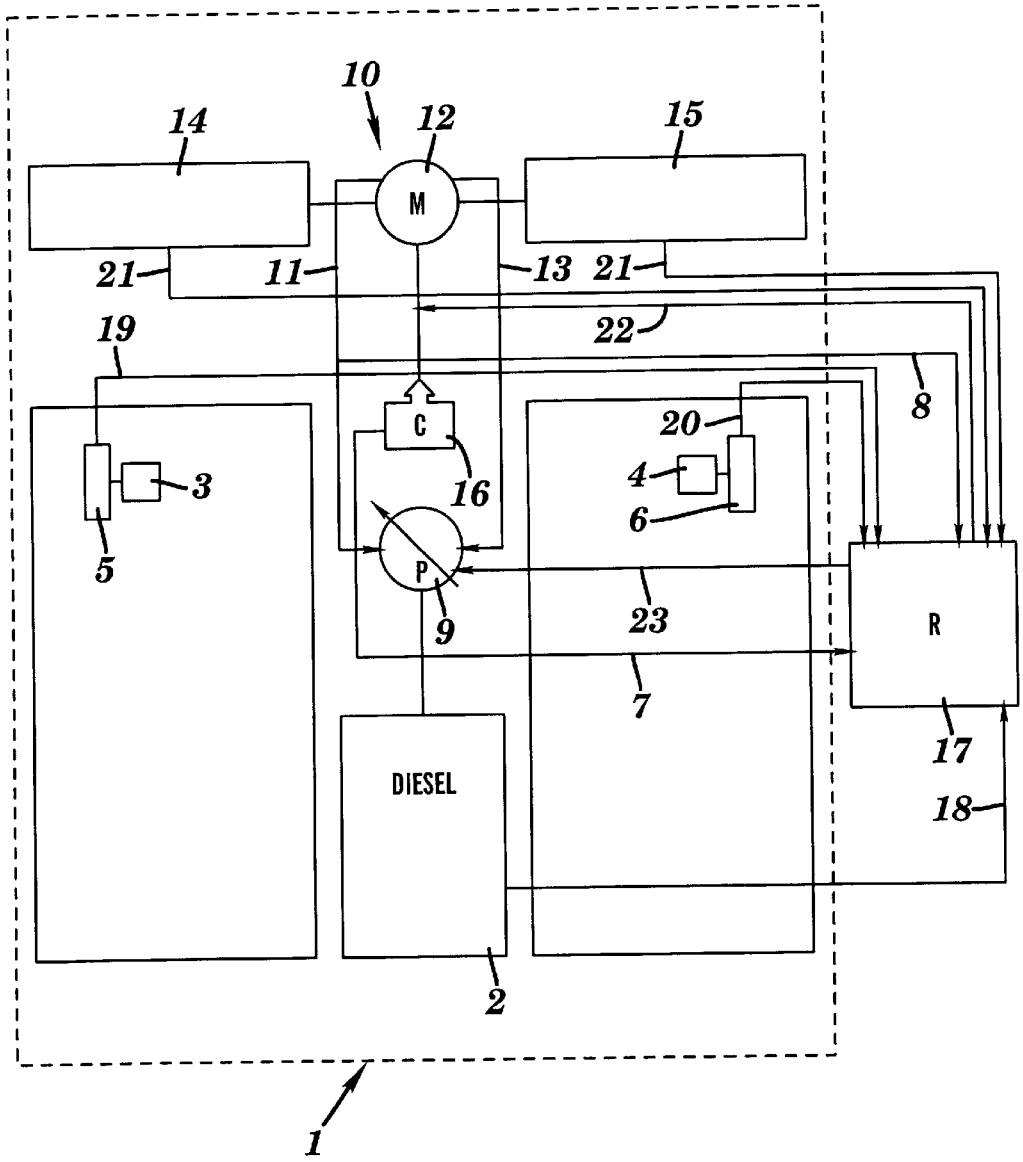
Figure 2:
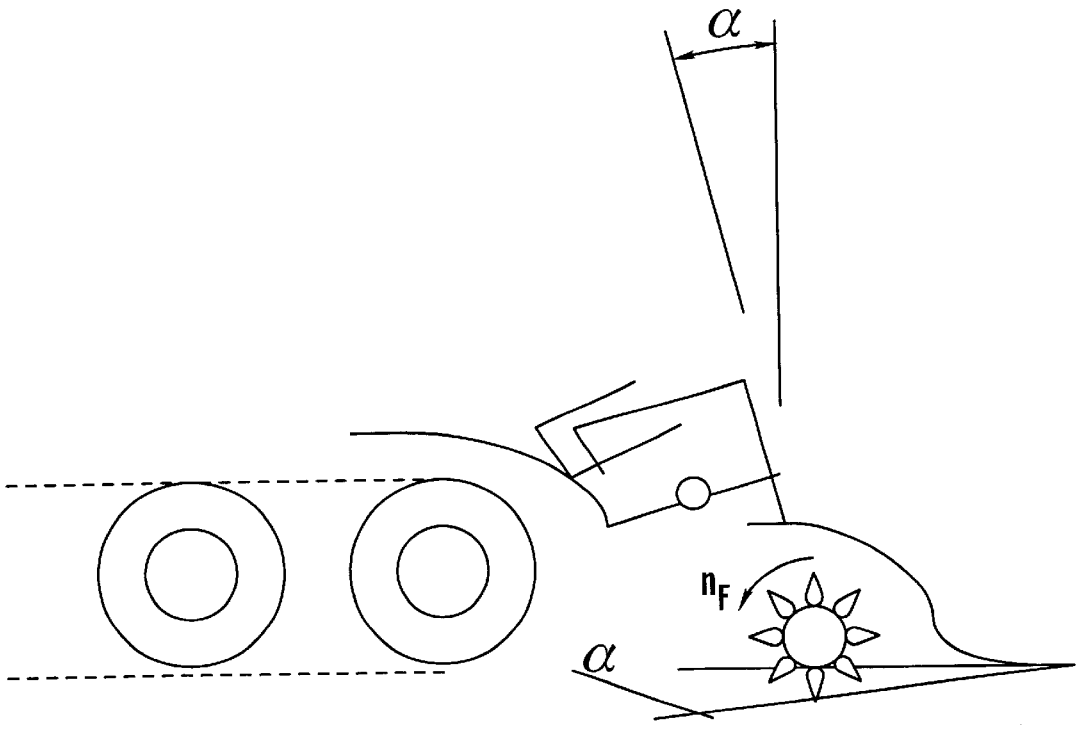
Figure 3B:
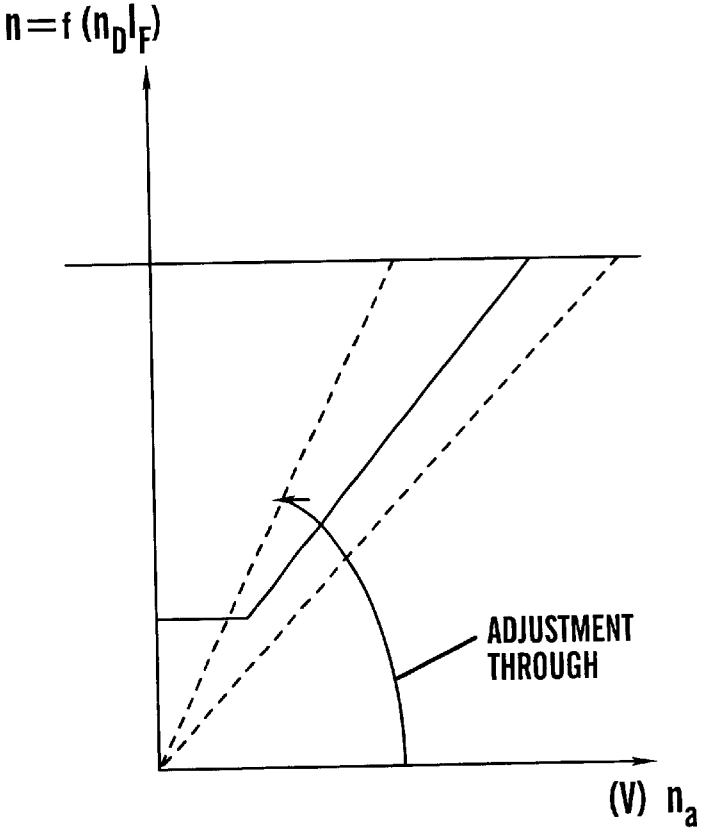
Figure 3A:
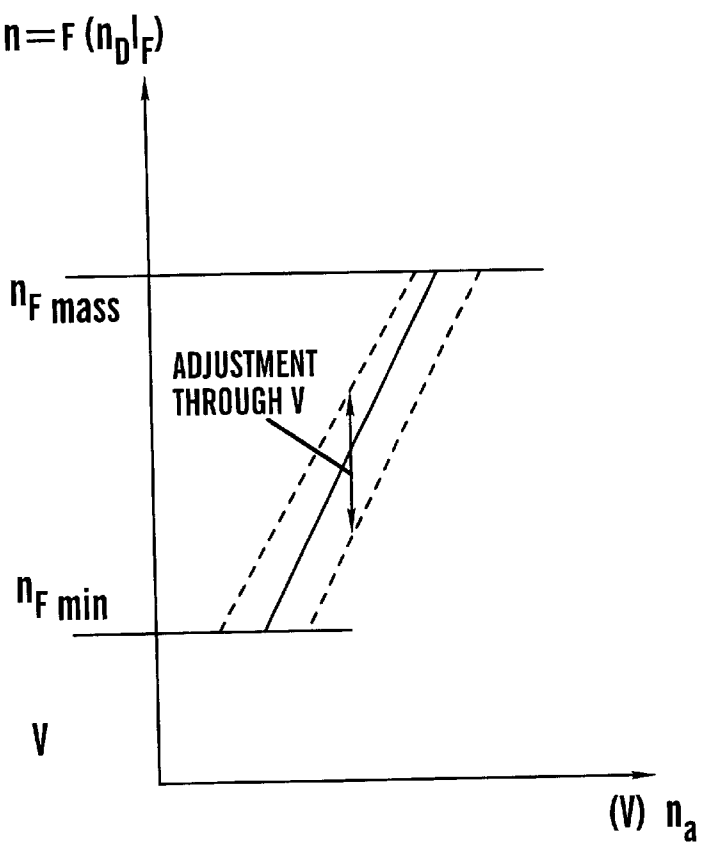
Figure 4:
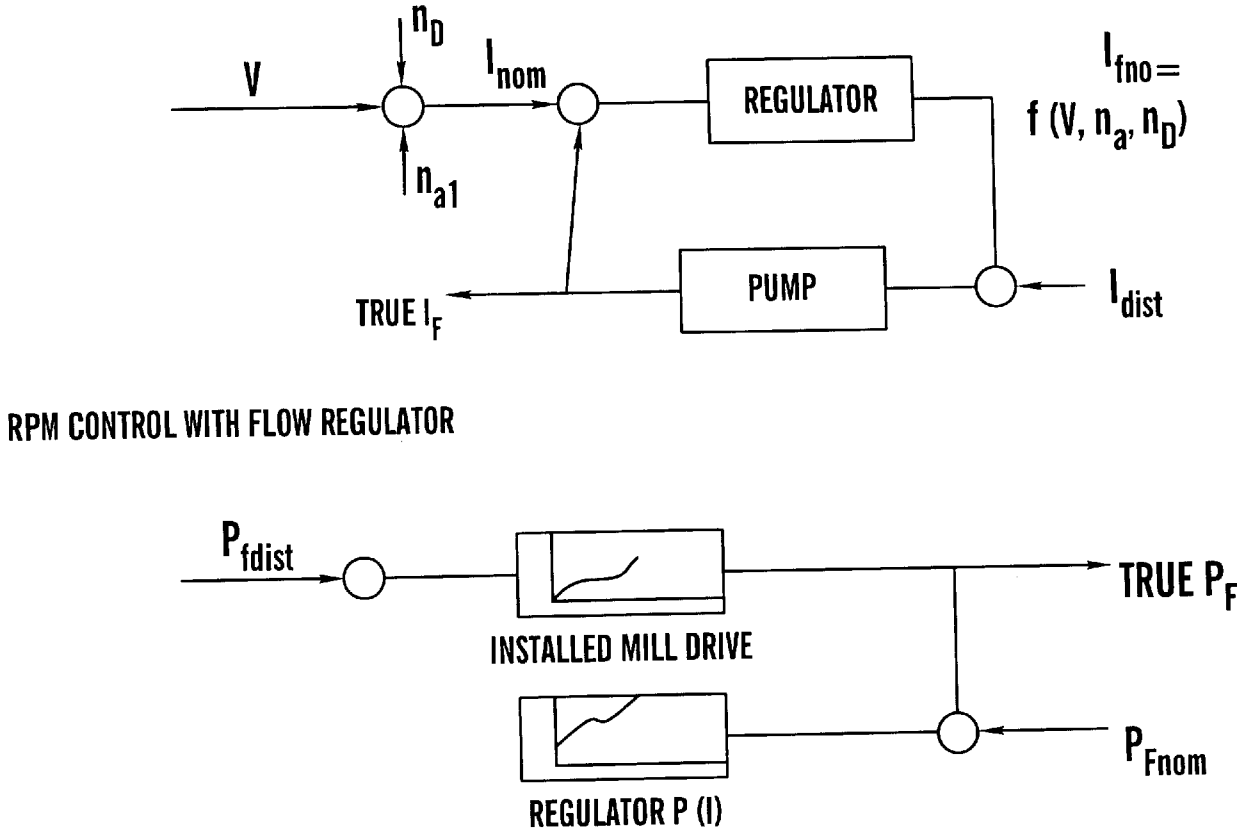
Figure 5:
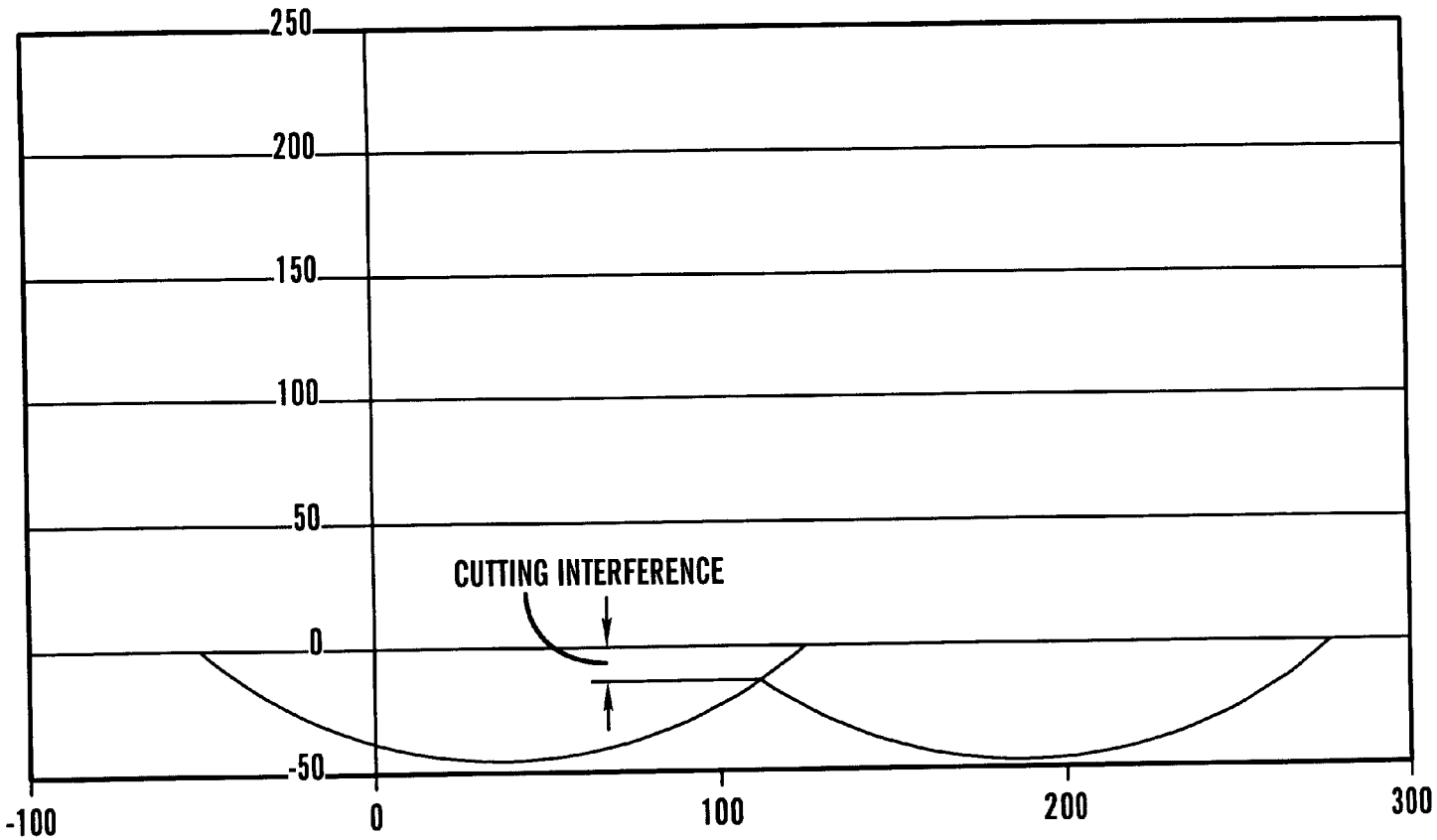
Figure 6:
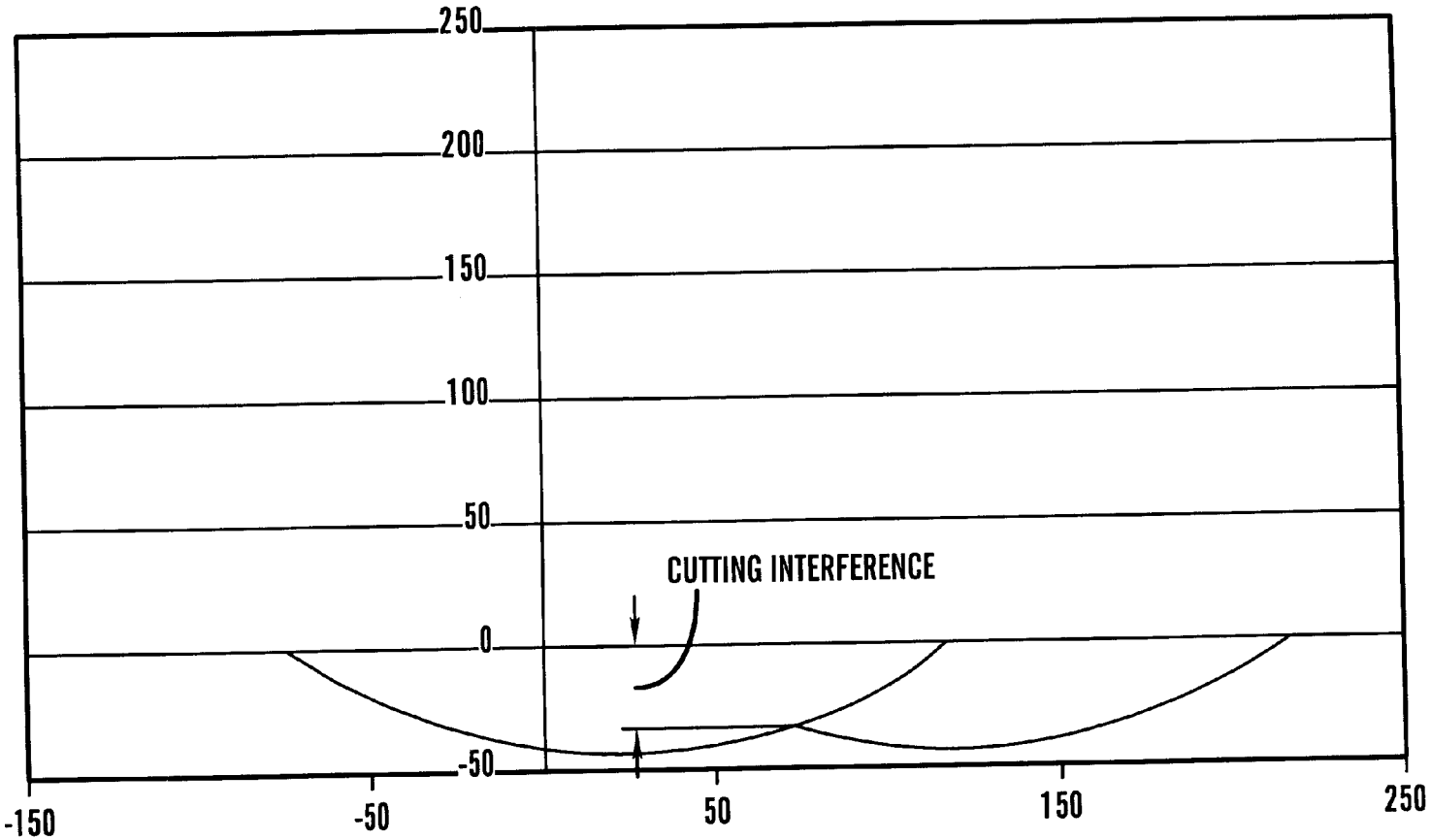

FIG. 1 shows a block diagram of an automatic control system for the cutting depth and rpm of a mill installed on snow track preparation machines, FIG. 2 shows diagrammatically a mill installed with indication of the cutting angle, FIGS. 3*a* and 3*b* show two diagrams representing mill rpm dependant upon drive rpm, FIG. 4 show diagrammatically the rpm control circuit with flow regulator and the pressure regulator respectively, and FIGS. 5 and 6 show different teeth engagement curves.

In FIG. 1 reference number 1 designates as a whole the outline of a ski track preparation machine in accordance with the present invention.

The snow track preparation machine includes a diesel motor 2 connected in a known manner to a drive 3 and a drive 4 which drive driving wheels 5 and 6 respectively. The diesel motor 2 also drives a control pump 9 and puts a hydrostatic circuit 10 into circulation.

The hydrostatic circuit 10 has a delivery duct 11 connected to a hydraulic motor 12 coupled through a return duct 13 to the control pump 9. The hydraulic motor 12 drives a mill 14, 15.

In accordance with the present invention pressure of the delivery duct 11 is controlled by a sensor not shown of known type connected through a duct 8 to a control unit 17.

Sensors of known type and thus not shown detect the rpm $n_F$ of the mill 14, 15 and supply the respective magnitudes through lines 21 to the control unit 17.

Sensors also of known type which read the rpm $n_{a1}$, $n_{a2}$ of the driving wheels 5 and 6 are also connected through lines 19 and 20 to the control unit 17. In a similar manner a sensor designed to read the diesel motor rpm is connected through a line 18 to the control unit 17.

As shown in FIG. 2 an actuator 16 is provided to control in a known manner the mill installed in a revolving manner around and angle $\alpha$ in its inclination (FIG. 2). A sensor designed to read the path and/or pressure of the actuator 16 is connected through a line 7 to the control unit 17.

The control unit 17 is return coupled through a line 22 to the actuator 16 and through a line 23 to the control pump 9 for reading thereof as fully explained below.

Automatic control of cutting depth and mill rpm takes place as follows.

The necessary path unit work control suited to snow conditions is provided by the user by means of a relationship of the mill rpm to the running speed and a torque setting.

Automatic control is accomplished using the control unit 17 which is fed the following measurements by sensors designated as follows:

diesel motor rpm $n_D$, drive wheels rpm $n_{a1}$, $n_{a2}$, and hydrostatic mill drive pressure $p_F$.

Then the control unit 17 determines the ratio of the diesel motor transmission to mill rpm ($n_D/n_F$) in the form of:

pump flow $I_F$ and crucial deflecting torque magnitude, and cutting angle $\alpha$ which thus represents the control magnitude $p_F$ shown as the result.

Magnitude Relations

To find the purpose W/s=const in a first moment it is assumed that it is to hold constant the number of mill teeth engaged per path unit. This hypothesis is based on test results which showed a correlation of this type. The relation running speed to mill roller peripheral speed ($v/v_u$) is used as magnitude for this ratio.

As running speed is directly proportionate to the rpm of the wheels and peripheral speed is proportionate to the rpm of the mill rollers it follows that:

the number of teeth engaged per path unit=$f(n_{a(1,2)}, n_F)$.

The rpm $n_F$ of the mill is also dependant on the rpm of the diesel motor and the transmission ratio ($n_D/n_F$) which in turn is influenced by pump flow $I_F$ alone.

Thus it is $n_F=f\ (n_{a(1,2)}, n_p, I_F)$ teeth engaged per path unit=$f\ (n_{a(1,2)}, n_p, I_F)$.

With determination of both the rpm magnitudes (see FIG. 1) with pump flow $I_F$ as control magnitude, we can find the setting teeth/path unit equals constant in which the purpose is achieved:

teeth engaged/path unit=constant=$f\ (n_{a(1,2)}, n_p, I_F)$.

Against the background of this 'rpm control' it can also be assumed that with a constant drive torque on the mill wheel the work per path unit ($W/s=M*\omega=M*f(n_f)$) will also be constant.

Thus: $W/s=\text{const.}=f(n_{a(1,2)}, n_p, I_F)_{const}, M_{const})$

After the subordinate influence of the mill shaft rpm the magnitude of dominant influence on the mill shaft drive torque is mill teeth cutting depth. This connection is based on analysis of the most widely used mills.

For geometrical reasons it is:

depth of cut=$f(\alpha)$ so that it is also true that:

$M=f(\alpha)$

On the basis of the hydrostatic mill drive of the usual type the pressure $p_F$ can be considered as the drive torque since the correlation $M=f(p_{F'})$ applies:

By control of the magnitude $\alpha$, the pressure $p_F$ or the torque M proportionate thereto can be held constant.

By combination of both the parts 'rpm control' and 'pressure or torque control' the purpose of the equipment described W/s=const is achieved.

Summarizing:

$n_a$, $n_D$=given for the running state $n_F=f(p_{F'})=f(\alpha)$

→W/s=const if the engaged teeth/s=f ($n_{a(1,2)}$, $n_p$, $I_F$)= constant and $M=f(\alpha)$=constant.

As mentioned above, the settings of the nominal values for rpm to torque ratio are predetermined independently of each other by the user to find an optimal regulation for snow conditions which is subsequently regulated as constant.

Finding the nominal values takes place for both the magnitudes using control members which emit for example an analogical signal as a value, for example a potentiometer.

V rpm ratio

P pressure setting

Since the practical use of mills even for running speed ($n_a$)=0 requires a mill rpm >0, calculation of the nominal values is performed correspondingly to one of the following correlations. In contrast therewith the nominal value is directly taken from the control member for the torque or pressure.

Since in practical use it has been shown that in particular in the range of low running speeds work is done under more than proportionate speed conditions for practical performance the variant 2*a* was chosen.

$N_{Fmass}$ is the result because of the drive limitations since with a given diesel motor rpm and the highest transmission ratio the limit rpm are reached on the mill shaft.

Otherwise the $V/V_u$ connection is predetermined correspondingly to a freely selectable control so that different teeth engagement curves are the result (see FIGS. 5 and 6).

Control or regulation for accomplishment of the objective are structured as in FIG. 4.

It is clear that for operation of the pump other sources of power such as for example an electric motor driven by a generator or even fuel cells or any other type of force of known type or still to be developed can be provided.

What is claimed is:

1. Snow track preparation machine with mill installed in a revolving manner and including a pump driven by a power source, a hydraulic motor connected to the pump on the delivery side and the return side, an actuator supported on the assembly frame and realized for rotation of the mill and driving wheels characterized by the fact that the power source is made up of a motor (2) which drives the driving wheels (5,6) and the pump (9) and the actuator (16) are influenced by a control unit (17) connected to a sensor of motor rpm $n_D$ with a sensor of the rpm of the driving wheels $n_{a1}$ and $n_{a2}$ with a sensor for the hydraulic motor of the moll and a sensor for the path actuator with the control unit (17) connecting the magnitudes detected by the sensors by means of an algorithm and controlling on the basis thereof the pump (9) and the actuator.

2. Snow track preparation machine in accordance with claim 1 characterized in that the algorithm is made up so that the pressure in the hydrostatic mill drive (hydraulic motor 12) is held constant.

3. Snow track preparation machine in accordance with claims 1 and 2 characterized in that the power source is made up of fuel cells.

4. Snow track preparation machine in accordance with claim 1 characterized in that the algorithm is made up so that the number of mill teeth per path unit engaged in the snow is constant.

5. Snow track preparation machine in accordance with claim 1 characterized in that the algorithm is made up so that the number of mill teeth per path unit engaged in the snow and the mill torque are constant.

6. Snow track preparation machine in accordance with claim 2 characterized in that the algorithm is made up so that the number of mill teeth per path unit engaged in the snow is constant.

7. Snow track preparation machine in accordance with claim 2 characterized in that the algorithm is made up so that the number of mill teeth per path unit engaged in the snow and the mill torque are constant.

* * * * *